US005115709A

United States Patent [19]

Steele

[11] Patent Number: 5,115,709

[45] Date of Patent: May 26, 1992

[54] RELEASE MECHANISM FOR SPIN-STABILIZED SELF-PROPELLED MISSILES

[75] Inventor: Michael F. Steele, Fountain Valley, Calif.

[73] Assignee: Brunswick Corporation, Skokie, Ill.

[21] Appl. No.: 562,799

[22] Filed: Aug. 6, 1990

[51] Int. Cl.[5] ..... F41C 27/06; F41F 3/048

[52] U.S. Cl. ..... 89/1.808; 42/105

[58] Field of Search ..... 89/1.808, 1.807; 42/105

[56] References Cited

U.S. PATENT DOCUMENTS

| | | | |
|---|---|---|---|
| 3,936,295 | 2/1976 | Cromwell et al. | 277/216 |
| 4,395,836 | 8/1983 | Baker et al. | 42/105 |
| 4,403,435 | 9/1983 | Baker et al. | 89/1.808 |
| 4,406,210 | 9/1983 | Baker et al. | 89/1.808 |
| 4,798,771 | 1/1989 | Vogel | 384/912 |
| 4,973,172 | 11/1990 | Nisley et al. | 384/492 |

*Primary Examiner*—David H. Brown
*Attorney, Agent, or Firm*—Wood, Phillips, Mason, Recktenwald & VanSanten

[57] ABSTRACT

A release mechanism for facilitating launching a spin-stabilized self-propelled missile, which includes a rotary missile support and a launching support for supporting the rotary missile support for rotation about a spin axis and for movement axially of the spin axis. A nozzle assembly extends between the rotary missile support and the missile coaxial with the spin axis. A separable portion of the nozzle assembly moves axially in an aft direction under the influence of exhaust gases expelled by the missile. The separable portion strikes an abutment on the rotary missile support to effect rapid movement of the rotary missle support axially away from the missile on separation of the separable portion of the nozzle assembly. A low friction bearing is provided for engagement by the rotary missile support at its aft limit position of travel away from the missile to reduce spin momentum induced forces caused by the rotary missile support. Another low friction bearing surrounds the rotary missile support between the support and the launching support to further reduce spin momentum induced forces. A time release mechanism is provided for preventing aft movement of the rotary missile support during a given number of initial revolutions and for releasing the rotary missile support to allow aft movement thereof after the given number of initial revolutions. A prescribed clearance is provided between the missile and the launching support to prevent post-separation collisions between the missile and the lauching support.

18 Claims, 3 Drawing Sheets

RELEASE MECHANISM FOR SPIN-STABILIZED SELF-PROPELLED MISSILES

FIELD OF THE INVENTION

This invention generally relates to the launching of spin-stabilized self-propelled missiles and, particularly, to an improved release mechanism to reduce spin geometry induced forces.

BACKGROUND OF THE INVENTION

It has become increasingly important to eliminate the features associated with a ballistic trajectory ordinarily followed by rockets and other jet-propelled projectiles, by forming the projectiles as spherical spin-stabilized missiles. The term "spherical" herein and in the claims hereof is being used in a generic sense to mean line-of-sight projectiles or missiles. For instance, in the exemplary embodiment herein, the missile is spherical only in the forward half of the missile, the aft half being substantially conical in shape.

The spherical missile spins about an axis upwardly inclined relative to the intended straight-line path of flight and aligned with the missile propulsion thrust axis. The missile is released following ignition or activation of the propulsion system within the missile. The propulsion is effected by the reaction of the exhaust jet of, for example, a rocket motor housed within the missile shell. Such spherical spin-stabilized missiles often are provided in conjunction with attachments secured to the front end of an assault weapon such as a rifle.

Such spin-stabilized, spherical, self-propelled missiles experience difficulties in achieving missile spin axis alignment during attainment of desired rotational speed and in coordinating the spinning and release of the missile. Release of the missile prior to attainment of adequate rotational speed can result in trajectory errors. Delay of release after attainment of adequate rotational speed can result in a loss of propulsion range.

Consequently, attempts have been made to provide means for temporarily restraining and automatically releasing a spin-stabilized self-propelled spherical missile during spin-up. Some such attempts are shown in U.S. Pat. Nos. 3,245,350 to J. A. Kelly, dated Apr. 12, 1966; 3,554,078 to Joseph S. Horvath, dated Jan. 12, 1971; 4,395,836 to Baker et al., dated Aug. 2, 1983; and 4,403,435 to Baker et al., dated Sep. 13, 1983, the latter two patents being assigned to the assignee of this invention. These patents represent a continuing effort to provide workable spherical spin-stabilized missiles. Generally, a fusible link temporarily restrains and automatically releases the spherical missile during spin-up. Hot missile rocket exhaust gas weakens, by heating, and melts the fusible link which, prior to weakening by softening or melting, secures the missile to a rotary support means. Baker, U.S. Pat. No. 4,395,836 shows a novel unitary nozzle member having fusible joint means formed integrally therewith, between the missile and the rotary support means. Baker, U.S. Pat. No. 4,403,435 shows an improved nozzle assembly including projectile support means having open-ended receptacle means out of which fore and aft sections of the nozzle can move on fusing and separation of the fusible joint means. This patent also shows an improved register section for the missile or nozzle to improve alignment of the missile with the spin axis during initial separation of the fusible joint means.

A somewhat radical departure from the prior art is shown in copending application Ser. No. 195,657, filed May 18, 1988, and assigned to the assignee of the present invention. That invention is directed to a projectile release mechanism wherein a mass is caused to be urged or propelled rearwardly by the gases of the missile or other suitable stored energy mechanism to strike an abutment means on the turbine or rotary means for the missile to cause the rotary means, in its receptacle, to move rapidly away from the missile after separation of the fusible joint means. This allows positive missile retention by the launch system rotary means during coupling fusing and therefore eliminates pointing error tip off forces initiated during the coupling fusing process of prior apparatus. That invention represents a vast improvement in the prior art, in that the missile separates from its turbine assembly in less than 0.5 msec, compared to the 10 msec separation period encountered in earlier designs in the art. This huge reduction in separation time minimizes the transfer of separate impulse forces from the turbine coupling and assembly to the projectile.

Copending application Ser. No. 554,556, filed Jun. 19, 1990, and assigned to the assignee of the present invention discloses a novel method of aligning the axis of rotation of a spin-stabilized self-propelled missile with the spin axis of its rotary missile support means.

However, still further problems have been encountered designing such spin-stabilized self-propelled missile systems. A condition which has been termed "azimuth repointing errors" still can result from system deflections caused by angular momentum induced forces of the rotary means of the release mechanism being transferred to the support means or launching apparatus. In addition, with hand-held launching apparatus, such as a rifle, random projectile post-separation repointing errors may be caused by rifleman induced collisions between the projectile and the launching apparatus. This invention is directed, generally, to solving these additional problems.

SUMMARY OF THE INVENTION

An object, therefore, of the invention is to provide a new and improved release mechanism for facilitating launching a spin-stabilized self-propelled missile by minimizing, if not eliminating, azimuth repointing errors and manfired repointing errors of the character described.

Generally, in the exemplary embodiment of the invention, the release mechanism has support means including rotary means and means for supporting the rotary means for rotation about a spin axis and for movement axially of the spin axis. Nozzle means extend between the rotary means and the missile coaxial with the spin axis. Separation means are provided between the missile and at least a separable portion of the nozzle means to allow the separable nozzle portion to move axially in an aft direction under the influence of exhaust gases expelled by the missile. Abutment means are provided on the rotary means in the path of movement of and for striking by the separable nozzle portion to effect rapid movement of the rotary means axially away from the missile on separation of the separation means.

The invention contemplates providing low friction bearing means for engagement by the rotary means at its aft limit position of travel away from the missile to reduce spin momentum induced forces on the means for supporting the rotary means. In the preferred embodiment, the low friction bearing means may comprise a lubricated metal bearing. The metal bearing may be lubricated by an impregnated coating.

Another feature of the invention is to provide time release means for preventing aft movement of the rotary means during a given number of initial revolutions thereof and for releasing the rotary means and allowing aft movement of the rotary means after the given number of initial revolutions. This time release means is disclosed in the form of a collar about a portion of the rotary means. The collar has internal threads mating with external threads on the rotary means. The threads are opposite (or "left-handed") relative to the direction of rotation of the rotary means whereby the threaded connection becomes unthreaded automatically in response to rotation of the rotary means. The number of threads determine the time of release. Up to that time of release, the collar prevents axial movement rearwardly of the rotary means.

Still another feature of the invention is the provision of configuring the support means or launching apparatus frame to provide a given clearance with the projectile to minimize repointing errors caused by collisions between the launching apparatus and the projectile.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figures 1, 4:
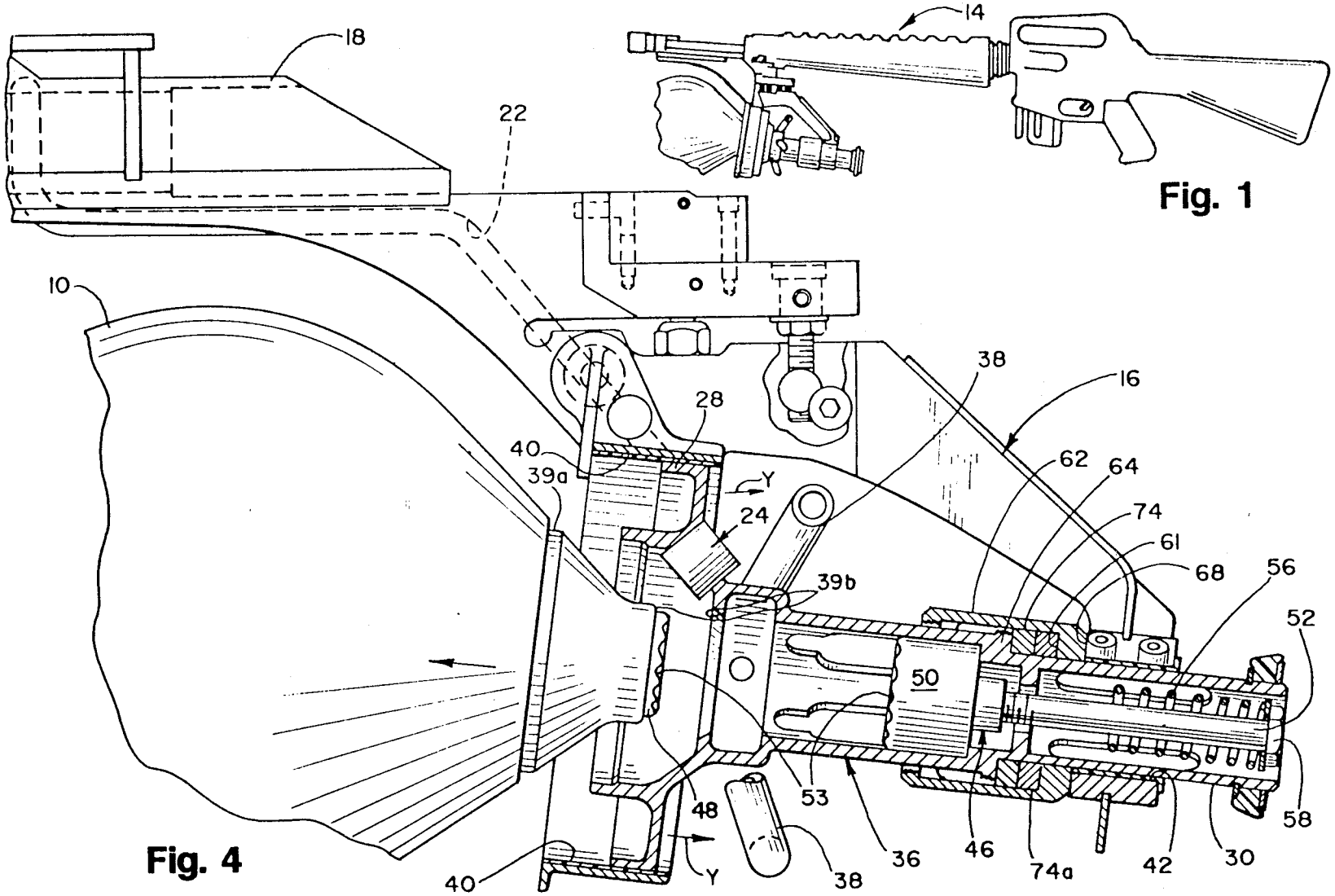
FIG. 1 is an elevational view of a spin-stabilized missile mounted on the barrel of a rifle and incorporating a release mechanism or launching apparatus for use with the alignment method and apparatus of the invention.
FIG. 4 is a view similar to that of FIGS. 2 and 3, showing the turbine assembly driven rearwardly against the launcher.

Referring to the drawings in greater detail and first to FIG. 1, a substantially spherical, spin-stabilized self-propelled missile 10 is shown mounted to the front of a barrel 12 of an assault weapon such as a rifle, generally designated 14. The rifle shown is a standard M-16A2 military rifle or any similar device. The deployment structure may be any fixed or portable structure, and the utility of the invention is not limited to a hand carried weapon such as a rifle.

Figure 2:
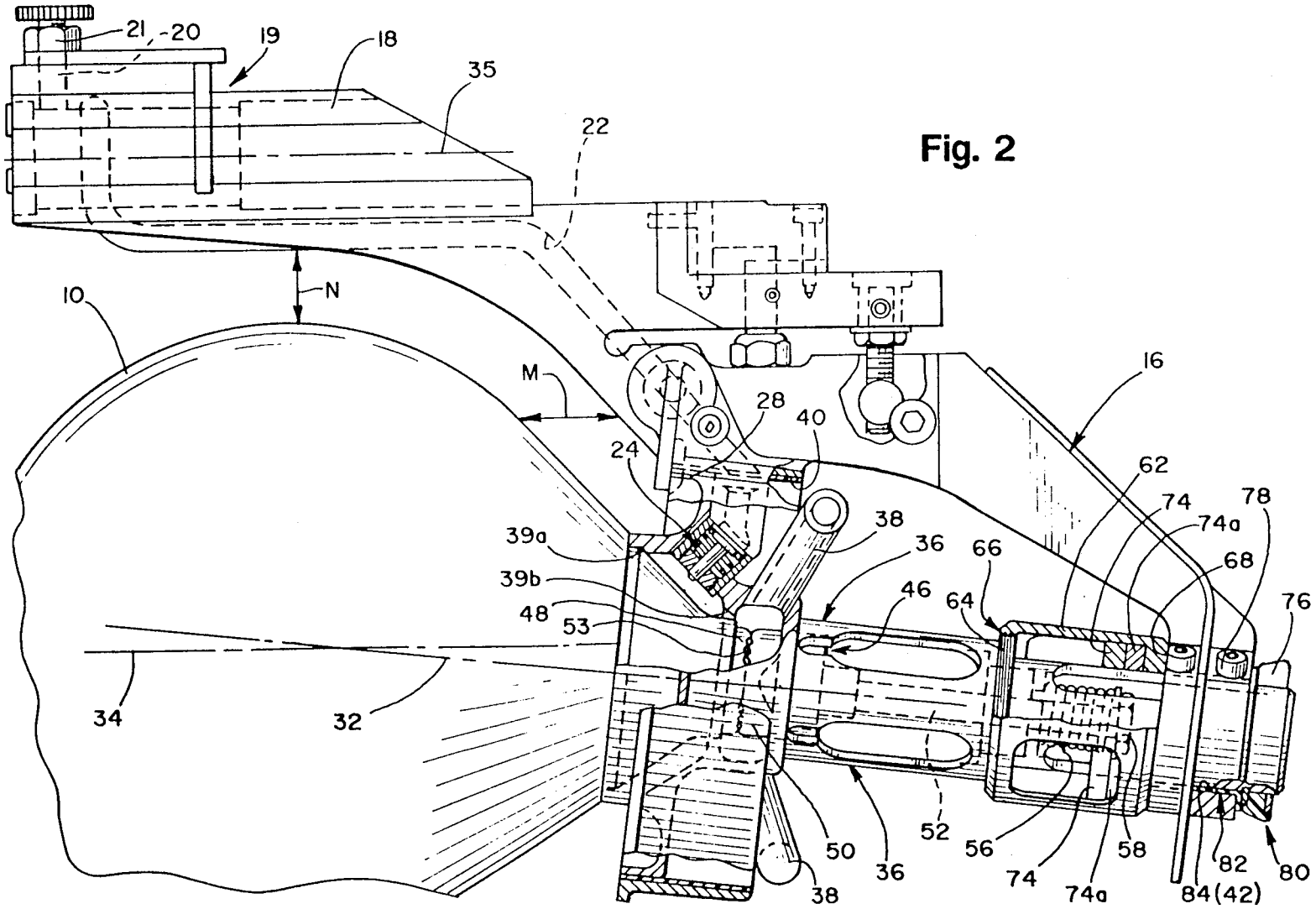
FIG. 2 is a fragmented side elevational view, partially in section and on an enlarged scale, showing some of the components of the missile and launching apparatus of FIG. 1 prior to ignition.

As shown FIG. 1, and the enlarged view of FIG. 2, a missile support means, generally designated 16, include a front upper attachment portion 18 with axial motion restraint means, generally designated 19. Attachment portion 18 is generally tubular for positioning over barrel 12, and a tightening screw 20 fixes the attachment portion to the barrel. A nut 21 locks the axial restraint means 19 in place by retaining a clamp bar 19*a*. The attachment portion 18 is positioned on barrel 12 whereby part of the gas emanating from the barrel is channeled through a passageway 22 (FIG. 2) to a firing pin assembly, generally designated 24, which is effective to strike a primer on missile 10 to ignite the rocket propellant therein, as is known in the art.

Support means 16 also include turbine support land portions 28 and 30 (FIG. 3) which support the missile and release mechanism on an axis 32 upwardly inclined relative to an intended straight-line path of flight 34 generally parallel to the axis 35 of rifle barrel 12. As is known in the art, axis 32 is the spin axis of the missile and turbine assembly (described hereinafter); i.e., the motor thrust axis of the missile rocket motor. Axis 34 which defines the line of flight of the missile is the forward velocity or down range component thereof.

Generally, self-propelled missile 10 is a spinning projectile launched from essentially a zero-length launcher. In other words, this is in contrast to a bullet which travels through the entire length of the rifle barrel or launch tube. For accuracy and trajectory repeatability, the missile must be maintained in constant alignment with spin axis 32 during spin-up and release. Furthermore, since the rifle is fired and recoils during spin-up and release of the missile, the missile release must be practically instantaneous in order to prevent launcher/-projectile impulse moments from redirecting the missile during the release process. These problems are addressed in the aforesaid copending application Ser. No. 195,657 which is incorporated herein by reference. That invention has been shown to be effective in assuring an undisturbed spin-up and launch event superior to any prior art and, as stated above, the missile disengages in less than 0.5 msec.

Suffice it to say herein, and still referring specifically to FIG. 2, a rotary missile support means or turbine rotary assembly, generally designated 36, includes a plurality of turbine nozzles 38. Preferably, four nozzles are provided, 90° apart, to provide uniform and equalized torque transmission forces. Rotary missile support means 36 has annular registration surfaces 39*a* and 39*b* for registering with complementary registration surfaces on missile 10. In assembly, rotary missile support means 36 includes land portions 40 and 42 for precisely registering with complementary land portions 28 and 30, respectively, on support means 16. These land portions are concentric with spin axis 32.

A nozzle assembly, generally designated 46, includes a fore section 48 and an aft section 50 fixed to a rearwardly projecting bolt-like shaft 52 having an externally threaded rear end. A meltable joint 53 integrally joins fore and aft sections 48 and 50, respectively. Rotary missile support means 36 has an internal, radially inwardly projecting annular flange 54. A support or connection means in the form of a coil spring 56 is sandwiched between flange 54 and a tightening nut 58 threaded onto the rear end of shaft 52. Therefore, missile 10 and nozzle assembly 46 are held within missile rotary support means by spring 56 and nut 58. In other words, rotary missile support means 36 provides receptacle means for missile 10 and nozzle assembly 46 to support the missile and nozzle assembly on spin axis 32.

Figure 3:
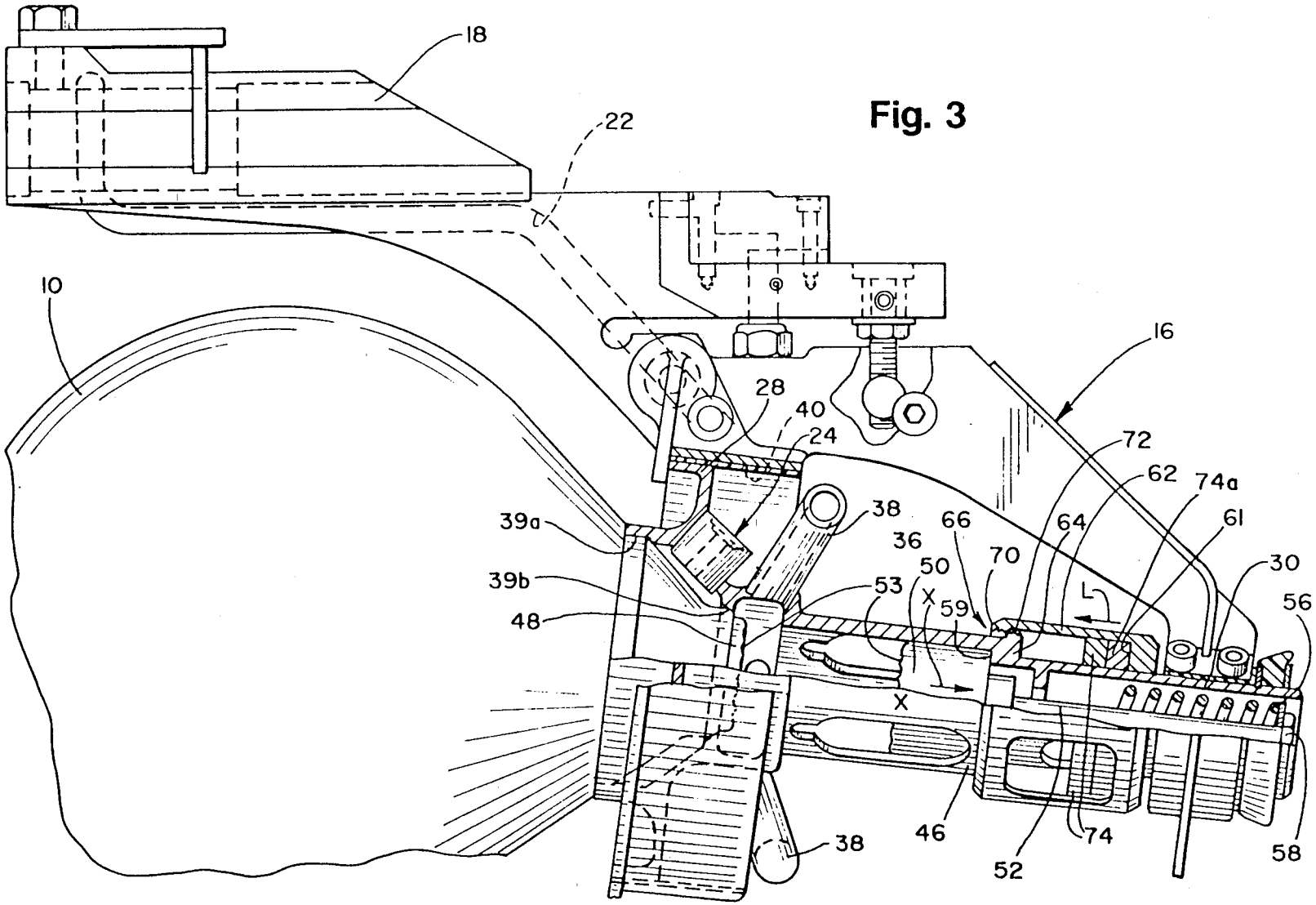
FIG. 3 is a view similar to that of FIG. 2, after separation of the fore and aft sections of the nozzle and on impact of the aft section with the launching apparatus.

Very briefly, referring to FIG. 3, when meltable joint 53 separates, aft section 50 of nozzle assembly 46 is driven aftwardly in the direction of arrow "X" until it strikes turbine assembly 36 at shoulders 59. The turbine assembly then is driven aftwardly in the direction of arrows "Y" as shown in FIG. 4 until it is stopped by shoulders 61 on a locking collar 62.

More particularly, and referring to FIG. 2, collar 62 and a flange 64 on rotary support means 36 of the missile have a threaded connection, generally designated 66. Collar 62 has a length extending rearwardly thereof so as to be in abutment with a shoulder 68 of the launcher support means 16. Therefore, it can be seen that with the rear abutment of collar 62 against the support means, and with threaded connection 66 between the forward end of the collar and rotary support means 36, the rotary support means is held against axial aft movement by the collar.

Referring to FIG. 3, threaded connection 66 is formed by internal threads 70 inside collar 62 and external threads 72 on the outside of flange 64 of rotary support means 36.

Collar 62 not only prevents aft movement of rotary support means 36, but it, in essence, forms a time release means for preventing aft movement of the rotary support means during a given number of initial revolutions thereof and for releasing the rotary support means and allowing aft movement of the rotary support means after that given number of initial revolutions This is accomplished by forming threads 70, 72 in a "left-handed" manner, i.e., opposite the direction of rotation of the rotary support means. Specifically, for clockwise rotating missiles (as viewed from the aft end or in the direction of the flight path) the threads would be left-handed. Conversely, if there is counter-clockwise missile rotation, the threads would be right-handed. Therefore, threaded connection 62 becomes unthreaded automatically in response to rotation of the rotary support means, as collar 62 moves forwardly in the direction of arrow "L" (FIG. 3) in response to the "unthreading" action. Once unthreaded, the collar now allows free movement of rotary support means 36 in a rearward direction.

Threads 70, 72 actually comprise a timing means of the time release means, effective to release the rotary means after the aforesaid predetermined number of revolutions. In other words, the number of threads in conjunction with the spin rate determine the time to axially unlock the turbine.

In actual practice, meltable joint 53 melts or separates at approximately four turbine revolutions. Threads 70, 72 may be configured to become unthreaded complementarily. Once aft section 50, which prior to joint 53 melting was integral with nozzle assembly 46, strikes shoulder 59, as described above and as seen in FIG. 3, the rotary support means is driven rearwardly in the direction of arrow "X" (FIG. 3) whereupon flange 64 of the rotary support means strikes a thrust bearing 74 and drives the bearing and collar 62 therewith until the collar strikes shoulder 68 of support means 16, as described above. Between the time of separation of threaded connection 66 and the separation of meltable joint 53, a light leaf spring 76 (FIG. 2), secured to support means 16 by appropriate fastening means 78, applies a forwardly directed force to the rear end of rotary support means 36 to maintain the components instantaneously in position prior to separation.

As stated above, azimuth repointing errors result from system deflections caused by the rotary support means transferring angular momentum induced forces to launcher support means 16. This is caused by friction between the rotary support means and the launcher support means, both from spin drag and from thrust contact during the "collision period". This angular momentum or torque transfer causes the rifle barrel muzzle to translate rotationally and causes launcher support means 16 to rotate about rifle barrel axis 35. As a result of these motions, it has been found that launcher support means 16 actually contacts missile 10 at least once, and sometimes twice, during approximately a 20 msec period following separation. During this contact, two tip off forces act on the missile. The first is the normal force resulting from the collision between the launcher support means and the missile. The second is at 90° to the normal force and is in the direction opposing missile spin. The latter force is generated as the missile attempts to restore the spin lost during the transfer of angular momentum from rotary support means 36 to launcher support means 16. The primary component of the vector sum of these forces cause a "nose down" missile momentum which results in azimuth repointing of the missile. Azimuth repointing errors ranging in eight mils have been observed in test procedures.

In order to minimize, if not eliminate, the azimuth repointing errors described above, low friction bearing means are provided for contacting by rotary support means 36 as it is driven rearwardly. More particularly, thrust bearing 74 is provided within collar 62 for striking by flange 64 of the rotary support means. Preferably, a second thrust bearing **74*a* is provided behind bearing 74. These bearings provide very low drag sliding surfaces which substantially eliminate angular momentum forces from being transferred from rotary support means 36 to collar 62 and, in turn, to launcher support means 16. Therefore, rotary support means/-launcher support means deflections are substantially eliminated. Bearings 74/74*a*** may comprise a lubricated metal bearing, the lubrication being provided by an impregnated coating. For instance, an aluminum bearing could be provided with a Teflon impregnated coating.

In addition, a similar type of bearing means, generally designated 80, may be provided on the rear distal end of the rotary support means for engaging spring 76 and reducing the braking action of the spring, thus further reducing any deflection forces.

Still further, similar bearing means, generally designated 82, may be provided surrounding the rear end of rotary support means 36, between the rotary support means and a surrounding bore 84 in launcher support means 16. Therefore, all of these bearing means between rotary support means 36 and its surrounding support means, whether the support means be collar 62, spring 76 or the launcher support means 16, itself, provide very low drag sliding surfaces wherever the rotary support means may engage another component upon impact after separation action of the system.

Lastly, the invention contemplates a system to improve manfired accuracy by eliminating random missile post-separation repointing errors caused by rifleman induced collisions between missile 10 and support means 16.

Specifically, from the instance that the rifle is fired and firing pin assembly 24 ignites the primer in the missile, through missile and rotary support means spin up, to separation and release of the missile, the rifleman feels a down load from the rifle barrel muzzle caused by the weight of the missile. In this time frame, the rifleman also senses the preserved pointing effect from the gyroscopic stiffness of the spinning missile and rotary support means, even though he is unable to detect any of the friction attenuated portion of the spinning mass torque load. Upon separation of the missile, the rifleman reacts to the rifle barrel unweighting and reduced pointing stiffness as the spinning mass is released. Approximately 10 msec after separation of the missile, the aft movement of the aft section of the nozzle assembly "colliding" with the rotary support means and, in turn, the "collision" of the rotary support means with the collar, and the collar with support means 16, all cause the rifle barrel to move sideways and downwardly and the rifle to recoil, all of which are sensed and reacted to by the rifleman. Even though most of the rifleman's sensed loads are in the vertical plane, his overreaction to these conditions normally generate random post-separation motions of support means 16. High speed film tests for such a hand held launching apparatus have shown a need for providing sufficient clearances between support means 16 and missile 10 to prevent collisions therebetween caused by the rifleman's overreaction transmitted to the support means. Very specifically, it has been found that a clearance of approximately one inch is needed between the missile and the support means during the first 50 msec of missile flight following separation and release.

Consequently, and referring to FIG. 2, the launching apparatus and release mechanism of the invention is designed to provide a one inch axial clearance between missile 10 and support means 16, as generally indicated by double-headed arrow "M", and a minimum of 0.75 inch vertical plane clearance between the missile and the support means, as generally indicated by arrow "N". In addition, it has proven to be similarly effective to have a minimum of one inch rearward travel of rotary support means 36 in its post-separation and release movement rearwardly, as described above. These parameters have been arrived at, using a seven pound missile having a diameter of 5½ inches in a vertical plane and which achieves 8.2 G's of down range acceleration when the missile separates from the rotary support means. This size of the missile presently is the most acceptable size for the largest family of planned warheads. Consequently, the one inch and 0.75 inch clearances are minimum parameters. Obviously, with a larger, heavier missile with different down range acceleration characteristics, more clearances between the missile and support means 16 might be required.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. A release mechanism for facilitating launching a spin-stabilized self-propelled missile, comprising:

support means including rotary means and means for supporting the rotary means for rotation about a spin axis and for movement axially of the rotary means along the spin axis;

nozzle means extending between said rotary means and the missile coaxial with said spin axis;

separation means between the missile and at least a separable portion of the nozzle means to allow said separable nozzle portion to move axially in an aft direction under the influence of exhaust gases expelled by the missile;

abutment means on the rotary means in the path of movement of and for striking by said separable nozzle portion to effect rapid movement of the rotary means axially away from the missile on separation of the separation means; and low friction bearing means for engagement by the rotary means at its aft limit position of travel away from the missile to reduce spin momentum induced forces on the means for supporting the rotary means.

2. The release mechanism of claim 1 wherein said low friction bearing means comprise a lubricated bearing.

3. The release mechanism of claim 2 wherein said bearing is lubricated by an impregnated coating.

4. A release mechanism for facilitating launching a spin-stabilized self-propelled missile, comprising:

support means including rotary means and means for supporting the rotary means for rotation about a spin axis and for movement axially of the rotary means along the spin axis;

nozzle means extending between said rotary means and the missile coaxial with said spin axis;

separation means for separating the missile from the rotary support means under the influence of exhaust gases expelled by the missile and for allowing aft movement of the rotary support means; and low friction bearing means for engagement by the rotary means at its aft limit position of travel away from the missile to reduce spin momentum induced forces on the means for supporting the rotary means.

5. The release mechanism of claim 4 wherein said low friction bearing means comprise a lubricated bearing.

6. The release mechanism of claim 5 wherein said bearing is lubricated by an impregnated coating.

7. A release mechanism for facilitating launching a spin-stabilized self-propelled missile, comprising:

support means including rotary means and means for supporting the rotary means for rotation about a spin axis and for movement axially of the rotary means along the spin axis;

nozzle means extending between said rotary means and the missile coaxial with said spin axis;

separation means between the missile and at least a separable portion of the nozzle means to allow said separable nozzle portion to move axially in an aft direction under the influence of exhaust gases expelled by the missile;

abutment means on the rotary means in the path of movement of and for striking by said separable nozzle portion to effect rapid movement of the rotary means axially away from the missile on separation of the separation means; and time release means for preventing aft movement of the rotary means during a given number of initial revolutions thereof and for releasing the rotary means and allowing aft movement of the rotary means after said given number of initial revolutions.

8. The release mechanism of claim 7 wherein said time release means include timing means effective to release the rotary means after said predetermined number of revolutions thereof.

9. The release mechanism of claim 8 wherein said timing means comprise a threaded connection between the rotary means and the time release means, including threads that are opposite the direction of rotation of the rotary means whereby the threaded connection becomes unthreaded automatically in response to rotation of the rotary means, and the number of threads determine the time of release.

10. The release mechanism of claim 9 wherein said time release means comprise a collar about a portion of the rotary means, the collar having internal threads and the rotary means having external threads.

11. A release mechanism for facilitating launching a spin-stabilized self-propelled missile, comprising:

support means including rotary means and means for supporting the rotary means for rotation about a spin axis and for movement axially of the rotary means along the spin axis;

nozzle means extending between said rotary means and the missile coaxial with said spin axis;

separation means for separating the missile from the rotary support means under the influence of exhaust gases expelled by the missile and for allowing aft movement of the rotary support means; and time release means for preventing aft movement of the rotary means during a given number of initial revolutions thereof and for releasing the rotary means and allowing aft movement of the rotary means after said given number of initial revolutions.

12. The release mechanism of claim 11 wherein said time release means include timing means effective to axially unlock the rotary means after said predetermined number of revolutions thereof.

13. The release mechanism of claim 12 wherein said timing means comprise a threaded connection between the rotary means and the time release means, including threads that are opposite the direction of rotation of the rotary means whereby the threaded connection becomes unthreaded automatically in response to rotation of the rotary means, and the number of threads in conjunction with the missile spin rate determine the time for axially unlocking the rotary means.

14. The release mechanism of claim 13 wherein said time release means comprise a collar about a portion of the rotary means, the collar having internal threads and the rotary means having external threads.

15. A release mechanism for facilitating launching a spin-stabilized self-propelled missile, comprising;

support means including rotary means and means for supporting the rotary means for rotation about a spin axis and for movement axially of the rotary means along the spin axis;

nozzle means extending between said rotary means and the missile coaxial with said spin axis;

separation means for separating the missile from the rotary support means under the influence of exhaust gases expelled by the missile and for allowing aft movement of the rotary support means; and wherein the support means is spaced from the missile a sufficient distance to prevent post-separation collision between the missile and the support means, the distance being a function of the mass and escape velocity of the missile.

16. The release mechanism of claim 15 wherein said distance is at least one inch between the missile and the support means in a fore-and-aft direction.

17. The release mechanism of claim 15 wherein said distance is at least 0.75 inch generally in a direction perpendicular to said spin axis.

18. The release mechanism of claim 17 wherein said distance is at least one inch between the missile and the support means in a fore-and-aft direction.

* * * * *